US007513586B2

(12) United States Patent
Mataki

(10) Patent No.: US 7,513,586 B2
(45) Date of Patent: Apr. 7, 2009

(54) WAVEFORM SIGNAL DRIVEN LIQUID EJECTION APPARATUS AND IMAGE FORMING APPARATUS

(75) Inventor: Hiroshi Mataki, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 453 days.

(21) Appl. No.: 11/392,818

(22) Filed: Mar. 30, 2006

(65) Prior Publication Data

US 2006/0221106 A1 Oct. 5, 2006

(30) Foreign Application Priority Data

Mar. 31, 2005 (JP) ..... 2005-103129

(51) Int. Cl.
*B41J 29/38* (2006.01)

(52) U.S. Cl. ..... 347/10; 347/57; 347/68

(58) Field of Classification Search ..... 347/9–11, 347/57–58, 60, 68, 70, 71
See application file for complete search history.

(56) References Cited

U.S. PATENT DOCUMENTS 6,799,821 B1 * 10/2004 Okuda ..... 347/10

FOREIGN PATENT DOCUMENTS

JP 2-184449 A 7/1990

* cited by examiner

*Primary Examiner*—Juanita D Stephens
(74) *Attorney, Agent, or Firm*—Birch, Stewart, Kolasch & Birch, LLP

(57) ABSTRACT

The liquid ejection apparatus comprises: a nozzle which ejects liquid; a pressure chamber which is connected to the nozzle and filled with the liquid to be ejected from the nozzle; an actuator which causes the liquid to be ejected from the nozzle by applying a pressure change to the liquid inside the pressure chamber, by changing volume of the pressure chamber; and a drive signal generating device which generates a drive signal for driving the actuator, wherein the drive signal includes: a first pull drive waveform component which drives the actuator to increase the volume of the pressure chamber; a push drive waveform component which drives the actuator to reduce the volume of the pressure chamber by a first volume change amount after the first pull drive waveform component, so as to push out a column of the liquid from the nozzle; and a second pull drive waveform component which drives the actuator to again increase the volume of the pressure chamber by a second volume change amount after the push drive waveform component, so as to sever the column of the liquid, an absolute value of the second volume change amount being not less than an absolute value of the first volume change amount.

17 Claims, 10 Drawing Sheets

FIG.11

| | |
|---|---|
| PRESSURE CHAMBER | 300 × 300 × 125 μm |
| SUPPLY PORT | 60 × 30 μm, LENGTH 200 μm |
| NOZZLE | DIAMETER 20 μm, LENGTH 200 μm |
| ACTUATOR | 2MPa-20pl (30V), RESONANCE POINT: 1MHz |
| VISCOSITY | 20cP |
| SURFACE TENSION | 30mN/m |

WAVEFORM SIGNAL DRIVEN LIQUID EJECTION APPARATUS AND IMAGE FORMING APPARATUS

BACKGROUND OF THE INVENTION

1. Field of the Invention

The present invention relates to a liquid ejection apparatus and an image forming apparatus, and more particularly, to a liquid ejection apparatus and an image forming apparatus using same, such as an inkjet recording apparatus, which is suitable to an application for ejecting a high-viscosity liquid in the form of very small liquid droplets.

2. Description of the Related Art

As a method of driving ejection in order to eject very small liquid droplets from an inkjet head, a method has been proposed in which the internal volume of an ink chamber is firstly increased, and then allowed to revert to its original state, thereby pushing the ink out from the nozzle, whereupon, before the ink thus pushed out is severed from the nozzle, the internal volume of the ink chamber is increased again in order to sever the ink from the nozzle (see Japanese Patent Application Publication No. 2-184449).

Japanese Patent Application Publication No. 2-184449 makes no mention of the ink viscosity. If the severance operation described above is not performed when high-viscosity ink is ejected, then sufficient negative pressure is not produced in order to "tear off" the liquid after pushing out the liquid because the applied pressure wave is attenuated rapidly due to the high viscosity of the ink, and hence the liquid stretches into a long column and it becomes difficult to form a very small liquid droplet. Therefore, in order to eject a high-viscosity liquid as a very small liquid droplet, then desirably, a waveform which tears off the liquid column (a waveform for severing the ink column) is added.

However, although Japanese Patent Application Publication No. 2-184449 discloses an ink severance operation, it does not refer to the timing of the effective increase in the internal volume of the ink chamber in the severance operation. In the case of a high-viscosity liquid, since the applied pressure wave attenuates rapidly, then unless a pull-back operation is performed at a specific timing in order to create a negative pressure which tears off the liquid column, it is not possible to obtain a negative pressure of a sufficient magnitude.

SUMMARY OF THE INVENTION

The present invention has been contrived in view of the foregoing circumstances, an object thereof being to provide a liquid ejection apparatus, and an image forming apparatus using same, whereby the conditions for obtaining a negative pressure that is sufficient to tear off the liquid column, even in the case of a high-viscosity liquid, are ascertained, and hence a high-viscosity liquid can be ejected in the form of a very small liquid droplet, on the basis of these conditions.

In order to attain the aforementioned object, the present invention is directed to a liquid ejection apparatus, comprising: a nozzle which ejects liquid; a pressure chamber which is connected to the nozzle and filled with the liquid to be ejected from the nozzle; an actuator which causes the liquid to be ejected from the nozzle by applying a pressure change to the liquid inside the pressure chamber, by changing volume of the pressure chamber; and a drive signal generating device which generates a drive signal for driving the actuator, wherein the drive signal includes: a first pull drive waveform component which drives the actuator to increase the volume of the pressure chamber; a push drive waveform component which drives the actuator to reduce the volume of the pressure chamber by a first volume change amount after the first pull drive waveform component, so as to push out a column of the liquid from the nozzle; and a second pull drive waveform component which drives the actuator to again increase the volume of the pressure chamber by a second volume change amount after the push drive waveform component, so as to sever the column of the liquid, an absolute value of the second volume change amount being not less than an absolute value of the first volume change amount.

The method for ejection driving according to the present invention is a method which initially performs a first pull operation which increases the volume of the pressure chamber, then performs a push operation which reduces the volume of the pressure chamber, thereby pushing a column of the liquid out from the nozzle, and then tears off (severs) the liquid column by performing a second pull operation which again increases the volume of the pressure chamber, thereby creating a very small liquid droplet. In this pull-push-pull driving, it is possible to generate a sufficient negative pressure in order to tear off the liquid column, by making the amount by which the liquid is pulled due to the second pull drive waveform component, equal to or greater than the amount by which the liquid is pushed due to the push drive waveform component. Thereby, it is possible to reliably sever (tear off) the liquid column of the ejected liquid, and hence a very small liquid droplet of highly viscous liquid can be ejected.

The drive signal may further include a pull holding waveform component which holds the state of the pressure chamber which has been caused to expand by the first pull drive waveform component, and a push holding waveform component which holds the state of the pressure chamber which has been compressed by the push drive waveform component. In other words, the drive signal may have a triangular-shaped voltage waveform consisting essentially of the first pull drive waveform component, the push drive waveform component and the second pull drive waveform component, or the drive signal may have a trapezoidal-shaped voltage waveform comprising the first pull drive waveform component, the pull holding waveform component, the push drive waveform component, the push holding waveform component, and the second pull drive waveform component.

Preferably, an intrinsic oscillation cycle Te of a volumetric speed of the liquid in the nozzle, and a period T1 from a first pull action due to the first pull drive waveform component until a push action due to the push drive waveform component, satisfy the following relationship: $(Te/2)-1\ \mu s \leqq T1 \leqq (Te/2)+1\ \mu s$.

If the conditions at which the liquid is ejected at the greatest speed are considered in the case of ejection based on a drive method which involves an initial pull and push action only (pull-push driving) (namely, the conditions of the period T0 until the push action following the pull action), then provided that this period T0 is one half of the intrinsic oscillation cycle Te of the volumetric speed of the liquid in the nozzle, an effect is produced whereby the pressure waveform created by the pull operation and the pressure waveform created by the push operation mutually reinforce (a constructive interference effect), and therefore a maximum ejection force is obtained.

Consequently, in the pull-push-pull drive method according to the present invention, desirably, the period T1 from the first pull action due to the first pull drive waveform component until the push action due to the push drive waveform component, is approximately equal to the period T0 in which liquid is ejected most quickly by means of only the pull and push ejection (pull-push driving), (in other words, the period T1 is approximately equal to ½ of the intrinsic oscillation cycle Te). From experimentation, a tolerance range of approximately ±1 μs is permitted, and therefore, satisfactory ejection can be achieved, provided that T1 is within the following range: $(Te/2)-1\ \mu s \leqq T1 \leqq (Te/2)+1\ \mu s$.

Preferably, a period T2 from a push action due to the push drive waveform component until a pull action due to the second pull drive waveform component, is not longer than a period T1 from a first pull action due to the first pull drive waveform component until the push action due to the push drive waveform component.

Desirably, the difference between T2 and T1 is small, and more desirably, T2 and T1 are the same (T2=T1). Accordingly, it is possible to utilize the resonance effect to perform ejection. Furthermore, by setting the application timing of the second pull drive waveform component, in such a manner that the pressure waveform generated by the pull-push action, and the pressure waveform generated by the second pull operation, mutually reinforce each other, then it is possible to achieve sufficient negative pressure in order to tear off the liquid column, even in the case of the high-viscosity liquid in which the pressure wave attenuates sharply, thereby making it possible to eject high-viscosity liquid in the form of very small liquid droplets.

Preferably, the drive signal further includes: a pull holding waveform component which drives the actuator to hold an expanded state of the pressure chamber of which the volume has been increased by the second pull drive waveform component; and a static state restoration waveform component which drives the actuator to reduce the volume of the pressure chamber having been held in the expanded state by the pull holding waveform component, so as to return the pressure chamber to a static state.

By holding the expanded state of the pressure chamber after the pull operation for tearing off the liquid column, refilling is promoted during this period. Furthermore, the pressure chamber is returned to a static state after ensuring a prescribed refilling time, thus preparing the chamber for the next ejection operation.

Preferably, a period T3 during which the pressure chamber is held in the expanded state by the pull holding waveform component is longer than a period T1 from a first pull action due to the first pull drive waveform component until a push action due to the push drive waveform component.

Consequently, by ensuring sufficient refilling time, as required, refilling can be performed swiftly and the ejection cycle can be shortened (the ejection frequency can be raised).

Preferably, the static state restoration waveform component has a gradient less than a gradient of the push drive waveform component.

According to this mode, it is possible to prevent a situation where the liquid is accidentally ejected from the nozzle during the compression action of the pressure chamber on the basis of the static state restoration waveform component.

Preferably, the liquid has viscosity of 10 cP through 50 cP.

The liquid ejection apparatus according to the present invention is particularly suitable as a device for ejecting the liquid of high viscosity which is subject to sharp pressure wave attenuation, in the form of very small liquid droplets.

Preferably, the following relationship is satisfied in the liquid ejection apparatus:

$$\frac{1}{\sqrt{1+\pi^2}} \times \sqrt{\frac{\rho \times ln \times ls}{(ln \times As + ls \times An) \times \left(\frac{V}{\rho \times c^2} + \frac{X}{P}\right)}} \leq$$

$$4 \times \pi \times \nu \times \frac{ln \times ls}{ln \times As^2 + ls \times An^2} \leq \sqrt{\frac{\rho \times ln \times ls}{(ln \times As + ls \times An) \times \left(\frac{V}{\rho \times c^2} + \frac{X}{P}\right)}},$$

where ln is a length of the nozzle; An is a surface area of the nozzle; ls is a flow channel length of a supply port through which the liquid is supplied to the pressure chamber; As is a surface are of the supply port; ρ is a density of the liquid; ν is a viscosity of the liquid; c is a speed of sound in the liquid; V is the volume of the pressure chamber; P is pressure generated by the actuator when a removed volume is X; and X is the removed volume by the actuator when the generated pressure is P.

The relationship described above indicates a condition derived on the basis of the oscillation conditions of the pressure change in the liquid, and conditions of sharp pressure wave attenuation where the second extreme point of the function indicating the pressure change is approximately equal to 1/e or less of the initial extreme point. By using the drive signal for pull-push-pull control according to the present invention, in the liquid ejection head which is composed so as to satisfy the above-described relationship, then it becomes possible to eject very small liquid droplets.

In order to attain the aforementioned object, the present invention is also directed to an image forming apparatus, comprising the above-described liquid ejection apparatus, which forms an image on a recording medium by means of an ink liquid ejected from the nozzle.

According to this image forming apparatus, color conversion or halftoning is carried out on the basis of image data (print data) inputted through an image input device, thereby generating ejection data corresponding to the ink colors. The actuators corresponding to the nozzles of the liquid ejection head are driven and controlled in such a manner that ink droplets are ejected from the nozzles. In order to achieve a high-resolution image output, a desirable mode is one using a liquid ejection head (print head) in which a plurality of liquid droplet ejection elements (ink chamber units) are arranged at high density, each liquid droplet ejection element being constituted by a nozzle (ejection port) which ejects ink liquid, and a pressure chamber and an actuator corresponding to the nozzle.

A configuration embodiment of a liquid ejection head for this printing is a full line type head having a nozzle row in which a plurality of ejection ports (nozzle) are arranged through a length corresponding to the full width of the recording medium. In this case, a mode may be adopted in which a plurality of relatively short ejection head modules having nozzles rows which do not reach a length corresponding to the full width of the recording medium are combined and joined together, thereby forming nozzle rows of a length that correspond to the full width of the recording medium.

A full line type head is usually disposed in a direction perpendicular to the relative feed direction (relative conveyance direction) of the recording medium, but modes may also be adopted in which the head is disposed following an oblique direction that forms a prescribed angle with respect to the direction perpendicular to the relative conveyance direction.

"Recording medium" indicates a medium which receives the deposition of ink ejected from the ejection ports of a liquid ejection head (this medium may also be called a print medium, image forming medium, image receiving medium, ejection receiving medium, or the like). This term includes various types of media, irrespective of material and size, such as continuous paper, cut paper, sealed paper, resin sheets, such as OHP sheets, film, cloth, a printed circuit board on which a wiring pattern, or the like, is formed, and an intermediate transfer medium, and the like.

The movement device for causing the recording medium and the liquid ejection head to move relatively to each other may include a mode where the recording medium is conveyed with respect to a stationary (fixed) head, or a mode where a head is moved with respect to a stationary recording medium, or a mode where both the head and the recording medium are moved. When forming color images by means of an inkjet print head, it is possible to provide type print heads for each color of a plurality of colored inks (recording liquids), or it is possible to eject inks of a plurality of colors, from one print head.

According to the present invention, since a negative pressure capable of tearing off the liquid column is produced, even in the case of a liquid of high viscosity, then it is possible to eject a high-viscosity liquid in the form of a very small liquid droplet.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein:

FIG. 11 is a table showing an embodiment of the design specifications of the head.

DETAILED DESCRIPTION OF THE PREFERRED EMBODIMENTS

General Composition of Inkjet Recording Apparatus

Figure 1:
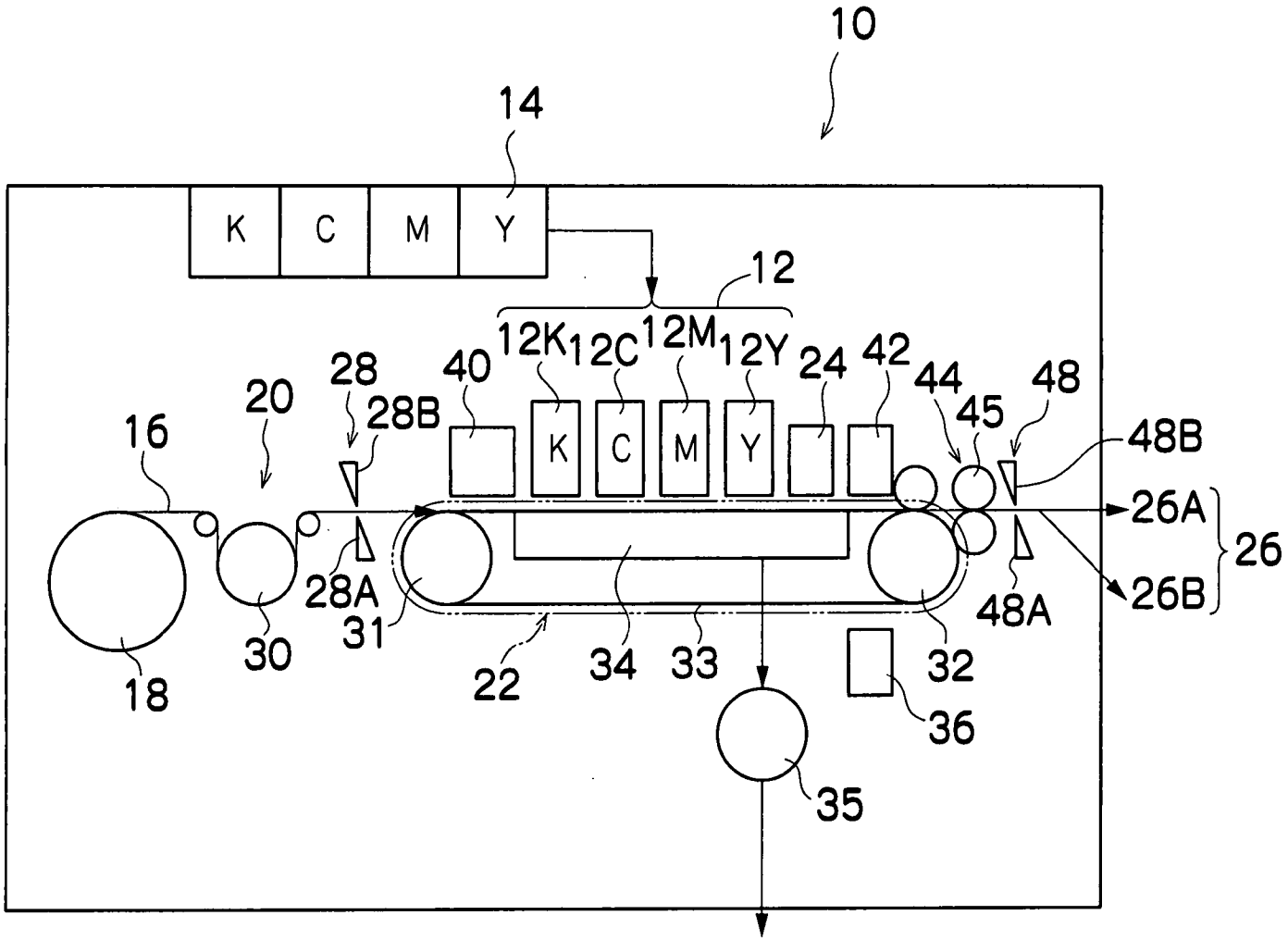
FIG. 1 is a general schematic drawing of an inkjet recording apparatus according to an embodiment of the present invention.

FIG. 1 is a diagram of the general composition of an inkjet recording apparatus according to an embodiment of the present invention. As shown in FIG. 1, the inkjet recording apparatus 10 comprises: a print unit 12 having a plurality of print heads 12K, 12C, 12M, and 12Y for ink colors of black (K), cyan (C), magenta (M), and yellow (Y), respectively; an ink storing and loading unit 14 for storing inks of K, C, M and Y to be supplied to the print heads 12K, 12C, 12M, and 12Y; a paper supply unit 18 for supplying recording paper 16; a decurling unit 20 for removing curl in the recording paper 16 supplied from the paper supply unit 18; a suction belt conveyance unit 22 disposed facing the nozzle face (ink-droplet ejection face) of the print unit 12, for conveying the recording paper 16 while keeping the recording paper 16 flat; a print determination unit 24 for reading the printed result produced by the print unit 12; and a paper output unit 26 for outputting image-printed recording paper (printed matter) to the exterior.

In FIG. 1, a magazine for rolled paper (continuous paper) is shown as an embodiment of the paper supply unit 18; however, a plurality of magazines with papers of different paper width and quality may be jointly provided. Moreover, papers may be supplied in cassettes that contain cut papers loaded in layers and that are used jointly or in lieu of magazines for rolled papers.

In the case of a configuration in which a plurality of types of recording paper can be used, it is preferable that an information recording medium such as a bar code and a wireless tag containing information about the type of paper is attached to the magazine, and by reading the information contained in the information recording medium with a predetermined reading device, the type of paper to be used is automatically determined, and ink droplet ejection is controlled so that the ink droplets are ejected in an appropriate manner in accordance with the type of paper.

The recording paper 16 delivered from the paper supply unit 18 retains curl due to having been loaded in the magazine. In order to remove the curl, heat is applied to the recording paper 16 in the decurling unit 20 by a heating drum 30 in the direction opposite to the curl direction in the magazine. In this, the heating temperature is preferably controlled in such a manner that the medium has a curl in which the surface on which the print is to be made is slightly rounded in the outward direction.

In the case of the configuration in which roll paper is used, a cutter (a first cutter) 28 is provided as shown in FIG. 1, and the continuous paper is cut to a desired size by the cutter 28. The cutter 28 has a stationary blade 28A, whose length is not less than the width of the conveyor pathway of the recording paper 16, and a round blade 28B, which moves along the stationary blade 28A. The stationary blade 28A is disposed on the reverse side of the printed surface of the recording paper 16, and the round blade 28B is disposed on the side adjacent to the printed surface across the conveyance path. When cut paper is used, the cutter 28 is not required.

After decurling in the decurling unit, the cut recording paper 16 is delivered to the suction belt conveyance unit 22. The suction belt conveyance unit 22 has a configuration in which an endless belt 33 is set around rollers 31 and 32 so that the portion of the endless belt 33 facing at least the nozzle face of the print unit 12 and the sensor face of the print determination unit 24 forms a horizontal plane (flat plane).

The belt 33 has a width that is greater than the width of the recording paper 16, and a plurality of suction apertures (not shown) are formed on the belt surface. A suction chamber 34 is disposed in a position facing the sensor surface of the print determination unit 24 and the nozzle surface of the printing unit 12 on the interior side of the belt 33, which is set around the rollers 31 and 32, as shown in FIG. 1; and this suction chamber 34 provides suction with a fan 35 to generate a negative pressure, thereby holding the recording paper 16 onto the belt 33 by suction. It is also possible to use an electrostatic attraction method, instead of a suction-based attraction method.

The belt 33 is driven in the clockwise direction in FIG. 1 by the motive force of a motor 88 (not shown in FIG. 1, but shown in FIG. 5) being transmitted to at least one of the rollers 31 and 32, which the belt 33 is set around, and the recording paper 16 held on the belt 33 is conveyed from left to right in FIG. 1.

Since ink adheres to the belt 33 when a marginless print job or the like is performed, a belt cleaning unit 36 is disposed in a predetermined position (a suitable position outside the printing area) on the exterior side of the belt 33. Although the details of the configuration of the belt cleaning unit 36 are not shown, embodiments thereof include a configuration in which the belt 33 is nipped with a cleaning roller such as a brush roller and a water absorbent roller, an air blow configuration in which clean air is blown onto the belt 33, or a combination of these. In the case of the configuration in which the belt 33 is nipped with the cleaning roller, it is preferable to make the linear velocity of the cleaning roller different to that of the belt 33, in order to improve the cleaning effect.

Instead of a suction belt conveyance unit 22, it might also be possible to use a roller nip conveyance mechanism, but since the print region passes through the roller nip, the printed surface of the paper makes contact with the rollers immediately after printing, and hence smearing of the image is liable to occur. Therefore, the suction belt conveyance mechanism in which nothing comes into contact with the image surface in the printing area is preferable.

A heating fan 40 is provided on the upstream side of the print unit 12 in the paper conveyance path formed by the suction belt conveyance unit 22. This heating fan 40 blows heated air onto the recording paper 16 before printing, and thereby heats up the recording paper 16. Heating the recording paper 16 before printing means that the ink will dry more readily after landing on the paper.

Figure 2:
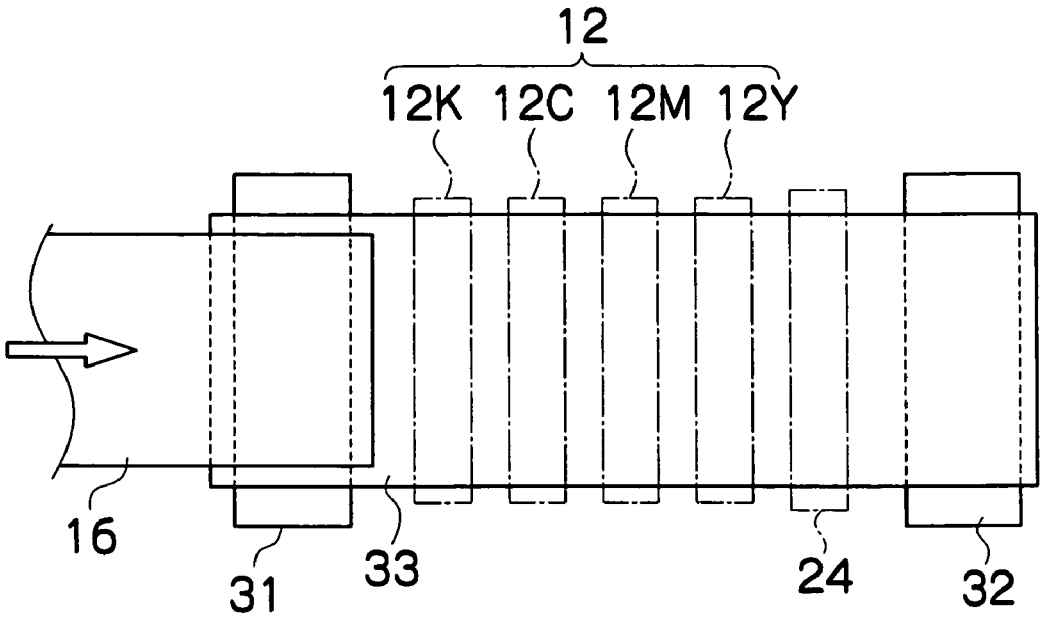
FIG. 2 is a principal plan diagram of the peripheral area of a print unit in the inkjet recording apparatus shown in FIG. 1.

The print unit 12 is a so-called "full line head" in which a line head having a length corresponding to the maximum paper width is arranged in a direction (main scanning direction) that is perpendicular to the paper feed direction (see FIG. 2). The detailed structure is described later with reference to FIGS. 3A to 4, and each of the print heads 12K, 12C, 12M, and 12Y is constituted by a line head, in which a plurality of ink ejection ports (nozzles) are arranged through a length that exceeds at least one side of the maximum-size recording paper 16 intended for use in the inkjet recording apparatus 10, as shown in FIG. 2.

The print heads 12K, 12C, 12M, and 12Y are arranged in color order (black (K), cyan (C), magenta (M), yellow (Y)) from the upstream side in the delivery direction of the recording paper 16, and these respective print heads 12K, 12M, 12C and 12Y are fixed extending in a direction substantially perpendicular to the conveyance direction of the recording paper 16.

A color image can be formed on the recording paper 16 by ejecting inks of different colors from the print heads 12K, 12M, 12C and 12Y, respectively, onto the recording paper 16, while the recording paper 16 is conveyed by the suction belt conveyance unit 22.

The print unit 12, in which the full-line heads covering the entire width of the paper are thus provided for the respective ink colors, can record an image over the entire surface of the recording paper 16 by performing the action of moving the recording paper 16 and the print unit 12 relatively to each other in the sub-scanning direction just once (in other words, by means of a single sub-scan). Higher-speed printing is thereby made possible and productivity can be improved in comparison with a shuttle type head configuration in which a print head moves reciprocally in the main scanning direction.

Although a configuration with the four standard colors of K, C, M and Y is described in the present embodiment, the combinations of the ink colors and the number of colors are not limited to those. Light and/or dark inks, and special color inks can be added as required. For example, a configuration is possible in which inkjet heads for ejecting light-colored inks such as light cyan and light magenta are added. Furthermore, there are no particular restrictions of the sequence in which the heads of respective colors are arranged.

As shown in FIG. 1, the ink storing and loading unit 14 has tanks for storing the inks of K, C, M and Y to be supplied to the print heads 12K, 12C, 12M, and 12Y, and the tanks are connected to the print heads 12K, 12C, 12M, and 12Y by means of channels (not shown). The ink storing and loading unit 14 has a warning device (for example, a display device or an alarm sound generator) for warning when the remaining amount of any ink is low, and has a mechanism for preventing loading errors among the colors.

The print determination unit 24 has an image sensor for capturing an image of the ink-droplet deposition result of the printing unit 12, and functions as a device to check for ejection defects such as clogs of the nozzles in the printing unit 12 from the ink-droplet deposition results evaluated by the image sensor.

The print determination unit 24 of the present embodiment is configured with at least a line sensor having rows of photoelectric transducing elements with a width that is greater than the ink-droplet ejection width of the print heads 12K, 12C, 12M, and 12Y. This line sensor has a color separation line CCD sensor including a red (R) sensor row composed of photoelectric transducing elements (pixels) arranged in a line provided with an R filter, a green (G) sensor row with a G filter, and a blue (B) sensor row with a B filter. Instead of a line sensor, it is possible to use an area sensor composed of photoelectric transducing elements which are arranged two-dimensionally.

The print determination unit 24 reads a test pattern image printed by the print heads 12K, 12C, 12M, and 12Y for the respective colors, and the ejection of each head is determined. The ejection determination includes the presence of the ejection, measurement of the dot size, and measurement of the dot landing position.

A post-drying unit 42 is disposed following the print determination unit 24. The post-drying unit 42 is a device to dry the printed image surface, and includes a heating fan, for example. It is preferable to avoid contact with the printed surface until the printed ink dries, and a device that blows heated air onto the printed surface is preferable.

In cases in which printing is performed with dye-based ink on porous paper, blocking the pores of the paper by the application of pressure prevents the ink from coming contact with ozone and other substance that cause dye molecules to break down, and has the effect of increasing the durability of the print.

A heating/pressurizing unit 44 is disposed following the post-drying unit 42. The heating/pressurizing unit 44 is a device to control the glossiness of the image surface, and the image surface is pressed with a pressure roller 45 having a predetermined uneven surface shape while the image surface is heated, and the uneven shape is transferred to the image surface.

The printed matter generated in this manner is outputted from the paper output unit 26. The target print (i.e., the result of printing the target image) and the test print are preferably outputted separately. In the inkjet recording apparatus 10, a sorting device (not shown) is provided for switching the outputting pathways in order to sort the printed matter with the target print and the printed matter with the test print, and to send them to paper output units 26A and 26B, respectively. When the target print and the test print are simultaneously formed in parallel on the same large sheet of paper, the test print portion is cut and separated by a cutter (second cutter)

48. The cutter 48 is disposed directly in front of the paper output unit 26, and is used for cutting the test print portion from the target print portion when a test print has been performed in the blank portion of the target print. The structure of the cutter 48 is the same as the first cutter 28 described above, and has a stationary blade 48A and a round blade 48B.

Although not shown in FIG. 1, the paper output unit 26A for the target prints is provided with a sorter for collecting prints according to print orders.

Structure of Head

Next, the structure of a print head is described. The print heads 12K, 12C, 12M and 12Y of the respective ink colors have the same structure, and a reference numeral 50 is hereinafter designated to any of the heads.

Figure 3A:
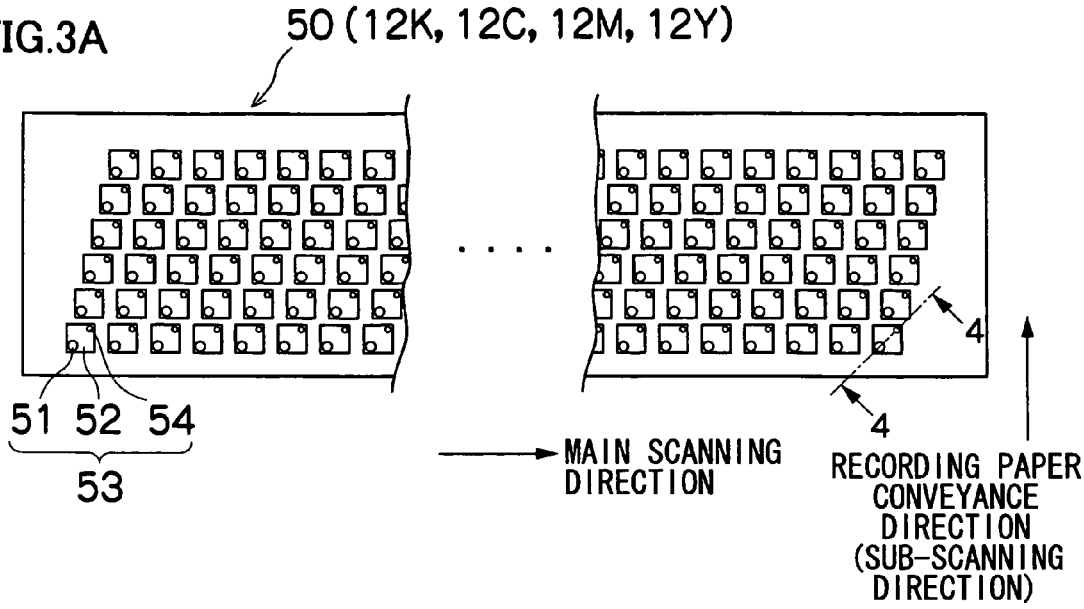
FIGS. 3A to 3C are plan perspective diagrams showing embodiments of the composition of a print head in the inkjet recording apparatus.
Figure 3B:
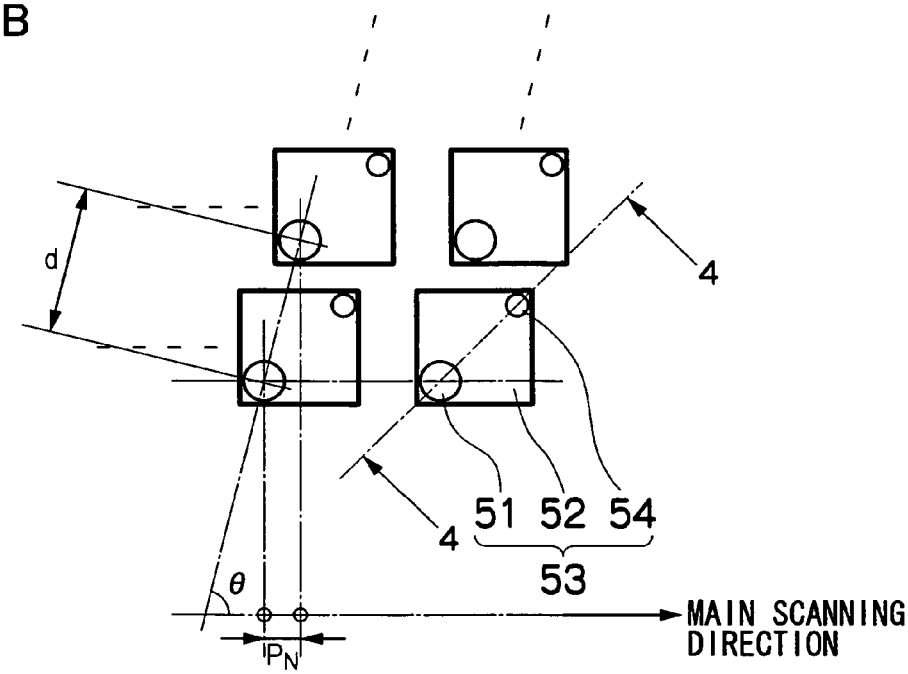
Figure 3C:
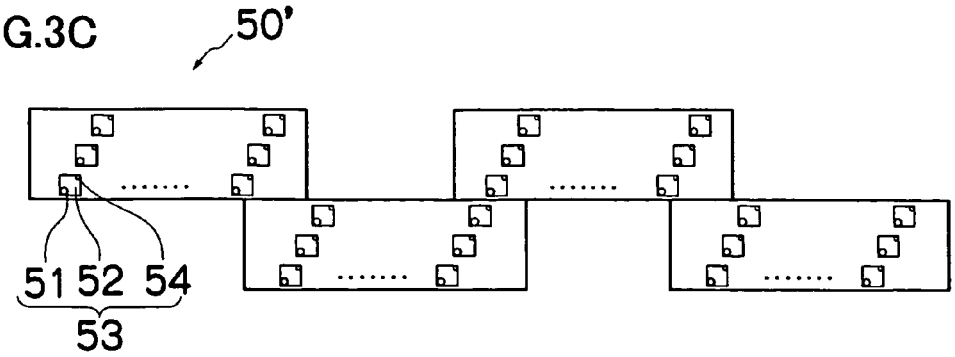
Figure 4:
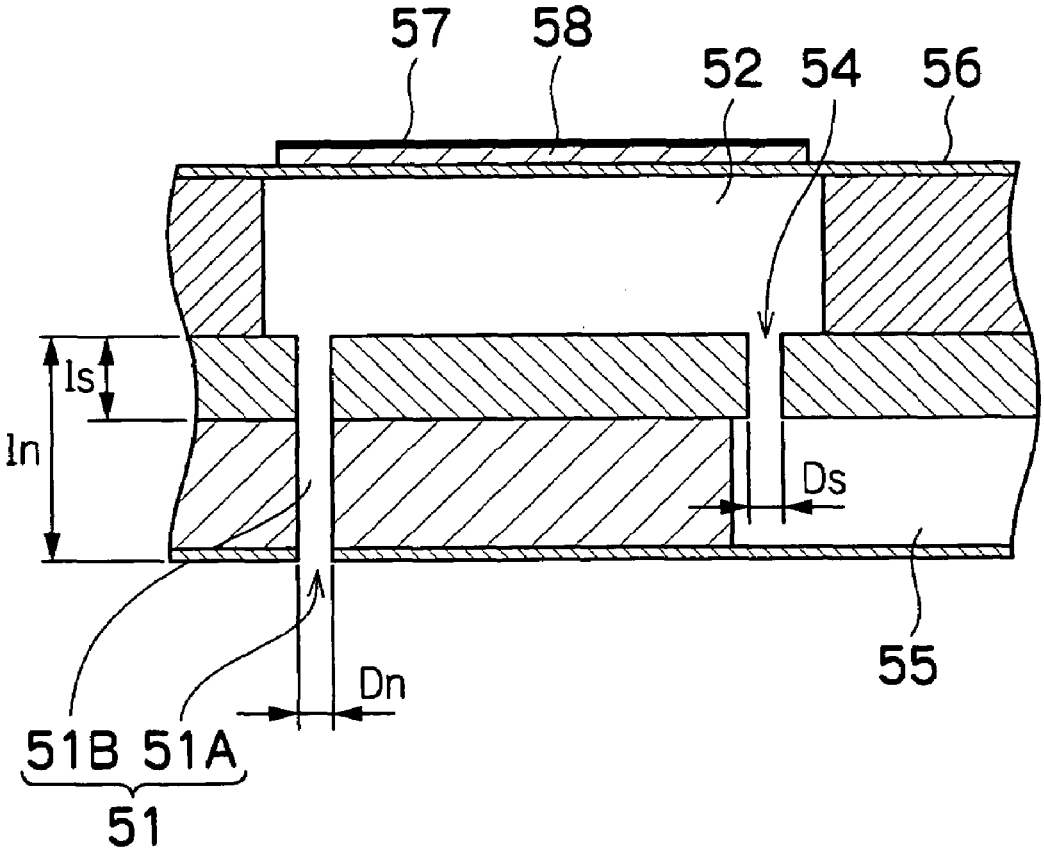
FIG. 4 is a diagram showing the three-dimensional structure of the print head shown in FIGS. 3A to 3C.

FIG. 3A is a plan view perspective diagram showing an embodiment of the composition of a print head 50, and FIG. 3B is an enlarged diagram of a portion of same. Furthermore, FIG. 3C is a plan view perspective diagram showing a further embodiment of the composition of the print head 50, and FIG. 4 is a cross-sectional diagram showing a three-dimensional composition of an ink chamber unit forming a unit liquid droplet ejection element (being a cross-sectional view along line 4-4 in FIG. 3A). In order to achieve a high resolution of the dots printed onto the surface of the recording medium, it is necessary to achieve a high density of the nozzles in the print head 50. As shown in FIGS. 3A to 4, the print head 50 in the present embodiments has a structure in which a plurality of ink chamber units 53 including nozzles 51 for ejecting ink droplets and pressure chambers 52 connecting to the nozzles 51 are arranged two-dimensionally in the form of a staggered matrix, and the effective nozzle pitch is thereby made small.

More specifically, as shown in FIGS. 3A and 3B, the print head 50 according to the present embodiment is a full-line head having one or more nozzle rows in which a plurality of nozzles 51 for ejecting ink are arranged along a length corresponding to the entire width (printable width) of the recording medium in a direction substantially perpendicular to the conveyance direction of the print medium (recording paper 16).

The mode of forming one or more nozzle rows through a length corresponding to the entire width of the recording paper 16 in a direction substantially perpendicular to the conveyance direction of the recording paper 16 (sub-scanning direction) is not limited to the embodiment described above. For example, instead of the configuration in FIG. 3A, as shown in FIG. 3C, a line head having nozzle rows of a length corresponding to the entire width of the recording paper 16 can be formed by arranging and combining, in a staggered matrix, short head modules 50' having a plurality of nozzles 51 arrayed in a two-dimensional fashion.

As shown in FIG. 3B, the planar shape of the pressure chamber 52 provided corresponding to each nozzle 51 is substantially a square shape, and an outlet port to the nozzle 51 is provided at one of the ends of a diagonal line of the planar shape, while an inlet port (supply port) 54 for supplying ink is provided at the other end thereof. The shape of the pressure chamber 52 is not limited to that of the present embodiment and various modes are possible in which the planar shape is a quadrilateral shape (rhombic shape, rectangular shape, or the like), a pentagonal shape, a hexagonal shape, or other polygonal shape, or a circular shape, elliptical shape, or the like.

As shown in FIG. 4, the pressure chamber 52 is connected to a common channel 55 through the supply port 54. The common channel 55 is connected to an ink tank (not shown in FIG. 4, and equivalent to the ink storing and loading unit 14 shown in FIG. 1), which is a base tank that supplies ink, and the ink supplied from the ink tank is delivered through the common flow channel 55 to the pressure chambers 52.

An actuator 58 (pressurization device) provided with an individual electrode 57 is bonded to a pressure plate (a diaphragm that also serves as a common electrode) 56 which forms the surface of one portion (in FIG. 4, the ceiling) of the pressure chambers 52. When a drive voltage is applied to the individual electrode 57, the actuator 58 deforms, thereby changing the volume of the pressure chamber 52. This causes a pressure change which results in ink being ejected from the nozzle 51. For the actuator 58, it is possible to adopt a piezoelectric element using a piezoelectric body, such as lead zirconate titanate, barium titanate, or the like. When the displacement of the actuator 58 returns to its original position after ejecting ink, the pressure chamber 52 is replenished with new ink from the common flow channel 55 through the supply port 54.

As shown in FIG. 4, each of the nozzles 51 provided in the print head 50 has a composition comprising a nozzle opening section 51A and an ejection side flow channel 51B connecting the pressure chamber 52 with the nozzle opening section 51A, and the diameter of the nozzle opening section 51A is Dn, the diameter of the ejection side flow channel 51B is Dn (the same as the diameter of the nozzle opening section 51A), and the length of the ejection side flow channel 51B is ln. The vicinity of the nozzle opening section 51A may be formed into a tapered shape, and the ejection side flow channel 51B may be formed by combining a plurality of flow channels (tube channels) having different diameters.

The supply port 54 connecting the pressure chamber 52 and the common flow channel 55 has a circular column shape of diameter Ds and flow channel length ls, as shown in FIG. 4.

As shown in FIG. 3B, the plurality of ink chamber units 53 having this structure are composed in a lattice arrangement, based on a fixed arrangement pattern having a row direction which coincides with the main scanning direction, and a column direction which, rather than being perpendicular to the main scanning direction, is inclined at a fixed angle of θ with respect to the main scanning direction. By adopting a structure wherein a plurality of ink chamber units 53 are arranged at a uniform pitch d in a direction having an angle θ with respect to the main scanning direction, the pitch $P_N$ of the nozzles when projected to an alignment in the main scanning direction (the effective nozzle pitch in the main scanning direction) is d×cos θ.

More specifically, the arrangement can be treated equivalently to one in which the nozzles 51 are arranged in a linear fashion at a uniform pitch $P_N$, in the main scanning direction. By means of this composition, it is possible to achieve a nozzle composition of high density, in which the nozzle columns projected to align in the main scanning direction reach a total of 2400 per inch (2400 nozzles per inch).

When implementing the present invention, the arrangement structure of the nozzles is not limited to the embodiment shown in the drawings, and it is also possible to apply various other types of nozzle arrangements, such as an arrangement structure in which nozzles are arranged in a row direction aligned with the main scanning direction and a column direction aligned with the sub-scanning direction.

In the present embodiment, a full line head having one or more nozzle row arranged through a length corresponding to the full width of the print medium in a direction substantially perpendicular to the conveyance direction of the print medium is described, but the scope of application of the present invention is not limited to this, and it is also possible to use a serial type (shuttle scanning type) of head which forms a row of dots aligned in the breadthways direction of the print medium, while moving a short head of a length that is smaller than the full width of the print medium.

Moreover, in the present embodiment, a single-layer piezoelectric element having one piezoelectric body layer is described (FIG. 4), but the present invention may also use a multiple-layer piezoelectric element in which two or more piezoelectric body layers are bonded together.

Furthermore, in the present embodiment, a mode is described in which the pressure plate 56 also serves as the common electrode, but it is also possible to provide the pressure plate 56 and the common electrode separately. In a mode in which the pressure plate 56 and the common electrode are provided separately, an insulating layer is provided between the pressure plate 56 and the common electrode, if a conductive material, such as a metallic material, is used as the pressure plate 56.

Description of Control System

Figure 5:
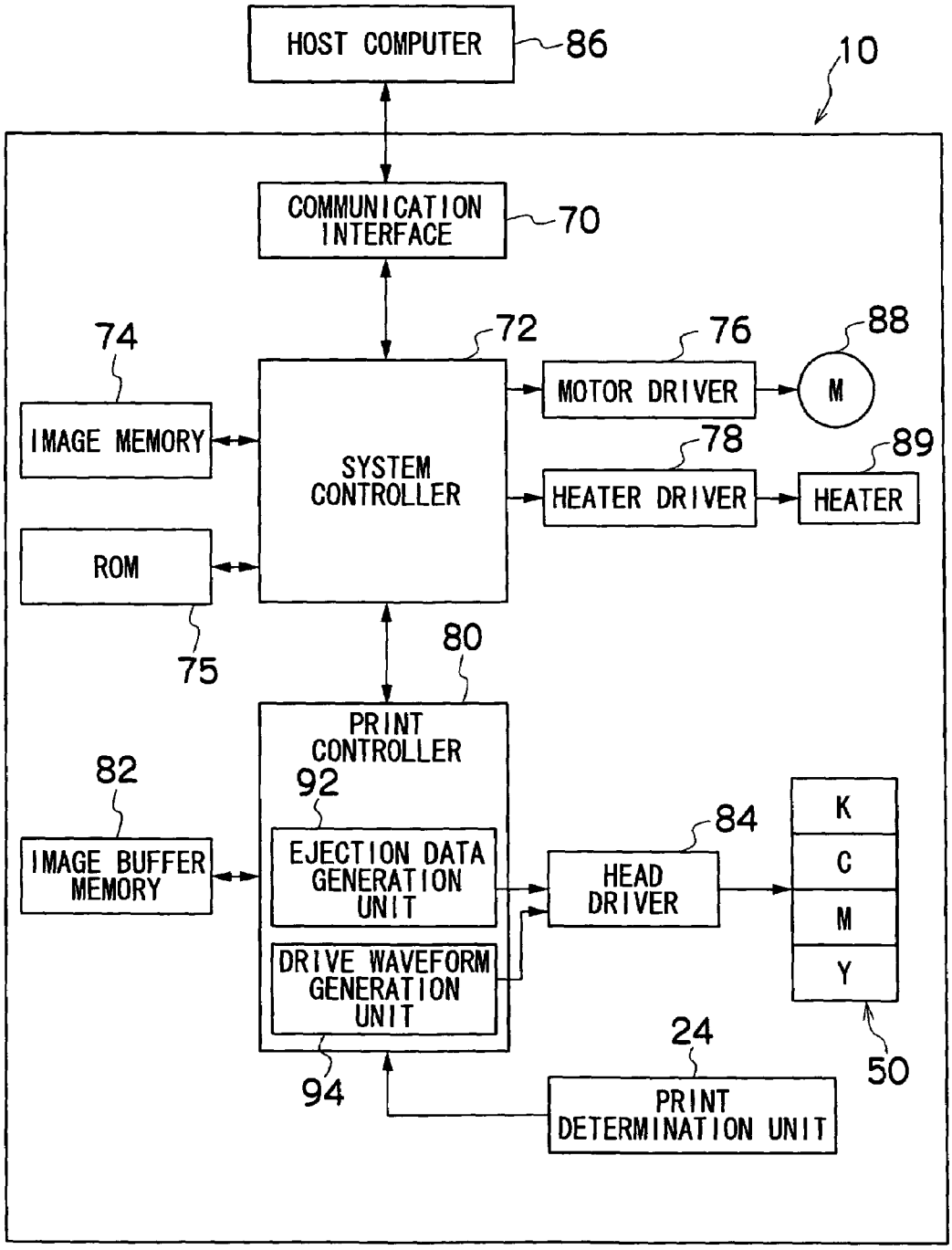
FIG. 5 is a principal block diagram showing the system composition of the inkjet recording apparatus.

FIG. 5 is a principal block diagram showing the system configuration of the inkjet recording apparatus 10. The inkjet recording apparatus 10 comprises a communication interface 70, a system controller 72, an image memory 74, a motor driver 76, a heater driver 78, a print controller 80, an image buffer memory 82, a head driver 84, and the like.

The communication interface 70 is an interface unit for receiving image data sent from a host computer 86. A serial interface such as USB, IEEE1394, Ethernet, wireless network, or a parallel interface such as a Centronics interface may be used as the communication interface 70. A buffer memory (not shown) may be mounted in this portion in order to increase the communication speed. The image data sent from the host computer 86 is received by the inkjet recording apparatus 10 through the communication interface 70, and is temporarily stored in the image memory 74.

The image memory 74 is a storage device for temporarily storing images inputted through the communication interface 70, and data is written and read to and from the image memory 74 through the system controller 72. The image memory 74 is not limited to a memory composed of semiconductor elements, and a hard disk drive or another magnetic medium may be used.

The system controller 72 is constituted by a central processing unit (CPU) and peripheral circuits thereof, and the like, and it functions as a control device for controlling the whole of the inkjet recording apparatus 10 in accordance with a prescribed program, as well as a calculation device for performing various calculations. More specifically, the system controller 72 controls the various sections, such as the communication interface 70, image memory 74, motor driver 76, heater driver 78, and the like, as well as controlling communications with the host computer 86 and writing and reading to and from the image memory 74, and it also generates control signals for controlling the motor 88 and heater 89 of the conveyance system.

The program executed by the CPU of the system controller 72 and the various types of data which are required for control procedures are stored in the ROM 75. The ROM 75 may be a non-writeable storage device, or it may be a rewriteable storage device, such as an EEPROM. The image memory 74 is used as a temporary storage region for the image data, and it is also used as a program development region and a calculation work region for the CPU.

The motor driver 76 drives the motor 88 in accordance with commands from the system controller 72. The heater driver 78 drives the heater 89 of the post-drying unit 42 or the like in accordance with commands from the system controller 72.

The print controller 80 is a control unit comprising an ejection data generation unit 92 having a signal processing function for performing various treatment processes, corrections, and the like, in accordance with the control implemented by the system controller 72, in order to generate a signal for controlling droplet ejection, from the image data (multiple-value input image data) in the image memory 74, and it functions as an ejection drive control device which supplies the ejection data (dot data) thus generated to the head driver 84.

An image buffer memory 82 is provided in the print controller 80, and image data, parameters, and other data are temporarily stored in the image buffer memory 82 when image data is processed in the print controller 80. FIG. 5 shows a mode in which the image buffer memory 82 is attached to the print controller 80; however, the image memory 74 may also serve as the image buffer memory 82. Also possible is a mode in which the print controller 80 and the system controller 72 are integrated to form a single processor.

To give a general description of the sequence of processing from image input to print output, image data to be printed (original image data) is input from an external source through a communications interface 70, and is accumulated in the image memory 74. At this stage, multiple-value RGB image data is stored in the image memory 74, for example.

In this inkjet recording apparatus 10, an image which appears to have a continuous tonal graduation to the human eye is formed by changing the droplet ejection density and the dot size of fine dots created by ink (coloring material), and therefore, it is necessary to convert the input digital image into a dot pattern which reproduces the tonal graduations of the image (namely, the light and shade toning of the image) as faithfully as possible. Therefore, original image data (RGB data) stored in the image memory 74 is sent to the ejection data generation unit 92 of the print controller 80, through the system controller 72, and is converted to the dot data for each ink color by a half-toning technique, using dithering, error diffusion, or the like, in the print controller 80.

In other words, the print controller 80 performs processing for converting the input RGB image data into dot data for the four colors of K, C, M and Y. The dot data generated by the print controller 80 in this way is stored in the image buffer memory 82. This dot data of the respective colors is converted into CMYK droplet ejection data for ejecting ink from the nozzles of the print head 50, thereby establishing the ink ejection data to be printed.

Furthermore, the print controller 80 also comprises a drive waveform generation unit 94 which generates a drive signal waveform for driving the actuators 58 of the print head 50, and the signal (drive waveform) generated by the drive waveform generation unit 94 is supplied to the head driver 84. The signal output from the drive signal generation unit 94 may be digital waveform data, or it may be an analog voltage signal.

The head driver 84 outputs drive signals for driving the actuators 58 corresponding to the respective nozzles 51 of the print head 50, in accordance with the print contents, on the basis of the ejection data supplied by the print controller 80 (in other words, the dot data stored in the image buffer memory 82, or the CMYK droplet ejection data or ink ejection data to be printed), and the drive waveform signal. A feedback control system for maintaining constant drive conditions in the head may be included in the head driver 84.

By supplying the drive signal output by the head driver 84 to the print head 50 in this way, ink is ejected from the corresponding nozzles 51. By controlling ink ejection from the print head 50 in synchronization with the conveyance speed of the recording paper 16, an image is formed on the recording paper 16. More specifically, the combination of the drive waveform generation unit 94 and the head driver 84 shown in FIG. 5 correspond to the "drive signal generation device" according to the present invention. The characteristic features of the drive signal output from the head driver 84 are further described later.

As described above, the ejection volume and the ejection timing of the ink droplets from the nozzles are controlled through the head driver 84, on the basis of the dot data generated by implementing prescribed signal processing in the print controller 80, and the drive signal waveform. By this means, prescribed dot size and dot positions can be achieved.

As described above with reference to FIG. 1, the print determination unit 24 is a block including an image sensor, which reads in the image printed onto the recording medium 16, performs various signal processing operations, and the like, and determines the print situation (presence/absence of ejection, variation in droplet ejection, optical density, and the like), these determination results being supplied to the print controller 80. Instead of or in conjunction with this print determination unit 24, it is also possible to provide another ejection determination device (corresponding to an ejection abnormality determination device).

As a further ejection determination device, it is possible to adopt, for example, a mode (internal determination method) in which a pressure sensor is provided inside or in the vicinity of each pressure chamber 52 of the print head 50, and ejection abnormalities are determined from the determination signals obtained from these pressure sensors when ink is ejected or when the actuators are driven in order to measure the pressure. Alternatively, it is also possible to adopt a mode (external determination method) using an optical determination system comprising a light source, such as laser light emitting element, and a photoreceptor element, whereby light, such as laser light, is irradiated onto the ink droplets ejected from the nozzles and the droplets in flight are determined by means of the transmitted light quantity (received light quantity).

The print controller 80 implements various corrections with respect to the print head 50, on the basis of the information obtained from the print determination unit 24 or another ejection determination device (not illustrated), according to requirements, and it implements control for carrying out cleaning operations (nozzle restoring operations), such as preliminary ejection, suctioning, or wiping, as and when necessary.

Description of Drive Signal

Next, a drive signal used in the inkjet recording apparatus 10 according to the present embodiment is described.

High-viscosity ink having a viscosity higher than that of generally used ink (namely, approximately 10 cP through 50 cP, where 1 cP=0.001 Pa·s) is used in the inkjet recording apparatus 10 according to the present embodiment, and a composition is adopted whereby a very small amount of high-viscosity ink is ejected at a short ejection cycle (namely, a high ejection frequency, for example, 40 kHz).

Figure 6:
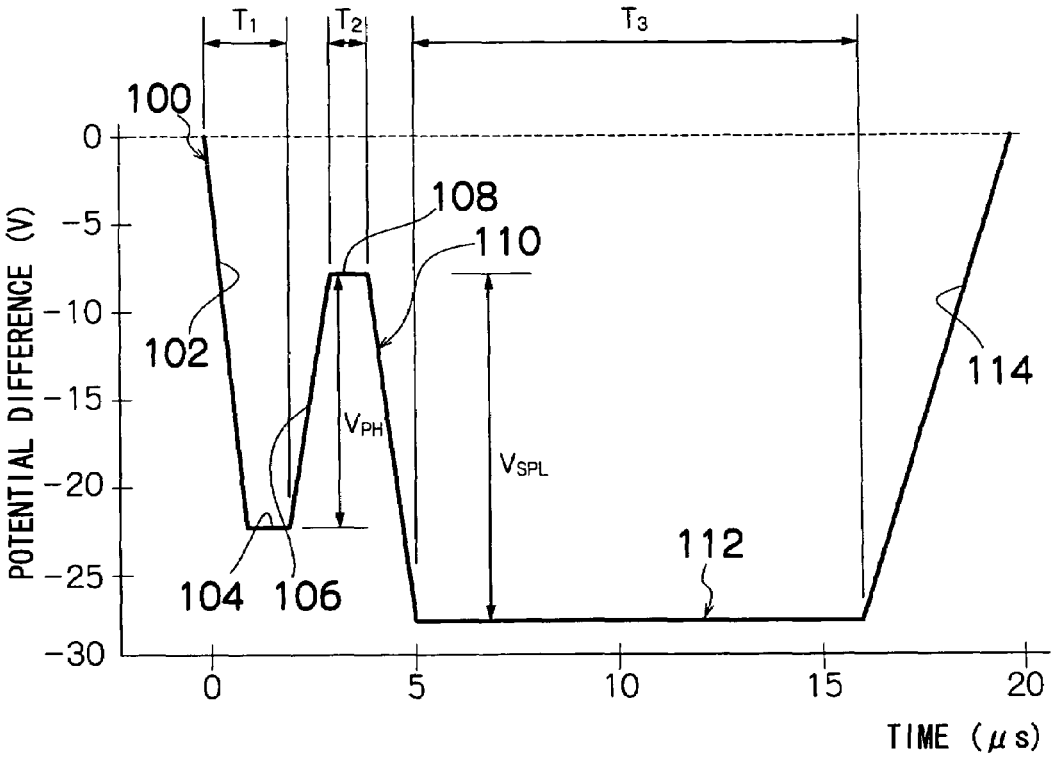
FIG. 6 is a waveform diagram showing one embodiment of a drive signal.

FIG. 6 is a waveform diagram showing one embodiment of the voltage waveform of the drive signal applied to the actuator 58. The waveform of this drive signal 100 includes: a first pull drive waveform component 102, which drives the actuator 58 in such a manner that the pressure plate 56 shown in FIG. 4 assumes a projecting form in the opposite direction from the nozzle 51, thereby causing the pressure chamber 52 to expand from its static state; a first pull holding waveform component 104, which holds the expanded state of the pressure chamber 52 having been caused to expand by the first pull drive waveform component 102; a push drive waveform component 106, which drives the actuator 58 in such a manner that the pressure plate 56 is deformed in the direction toward the nozzle 51, thereby compressing the pressure chamber 52; a push holding waveform component 108, which holds the compressed state of the pressure chamber 52 having been compressed by the push drive waveform component 106; a second pull drive waveform component 110, which causes the pressure chamber 52 to expand again; a second pull holding waveform component 112, which holds the expanded state of the pressure chamber 52 having been caused to expand by the second pull drive waveform component 110; and a static state restoration waveform component 114, which compresses the pressure chamber 52 having been held in the expanded state by the second pull holding waveform component 112, thereby returning the pressure chamber 52 to the static state.

The waveform of the drive signal 100 comprises, at the least, waveform components corresponding to an initial pull action, followed by a push action, and another pull action. The ink inside the pressure chamber 52 is ejected from the nozzle 51 by means of this pull-push-pull driving which combines a first pull operation and one push operation following same, together with a second pull operation. The second pull operation corresponds to an operation for severing the ink column caused to project from the nozzle 51 by the push operation (namely, an operation for tearing off the liquid column and creating a very small liquid droplet).

The characteristic features (1) to (5) of the waveform of the drive signal 100 for achieving this ejection operation are enumerated below.

Characteristic feature (1): The period T1 from the first pull action until the push action satisfies the following condition (1):

$$Tpp-1\ \mu s \leqq T1 \leqq Tpp+1\ \mu s \quad (1)$$

where Tpp is the period in which the liquid is ejected most quickly by means of only a pull and push ejection (pull-push driving). It has been confirmed experimentally that liquid is ejected, provided that the error of the period T1 is approximately ±1 microsecond with respect to the period Tpp. The value Tpp is described in detail later.

Characteristic feature (2): The period T2 until the pull action after the push action is not more than the period T1 from the first pull action until the push action (T2≦T1). Desirably, the value of T2 is in the vicinity of T1 (the difference between T2 and T1 is small), and more desirably, T2 is equal to T1.

Characteristic feature (3): The amount $V_{SPL}$ by which the liquid is pulled after the pull and push actions (amount of second pull) is not less than the amount $V_{PH}$ by which the liquid is pushed in the push action.

Figure 7:
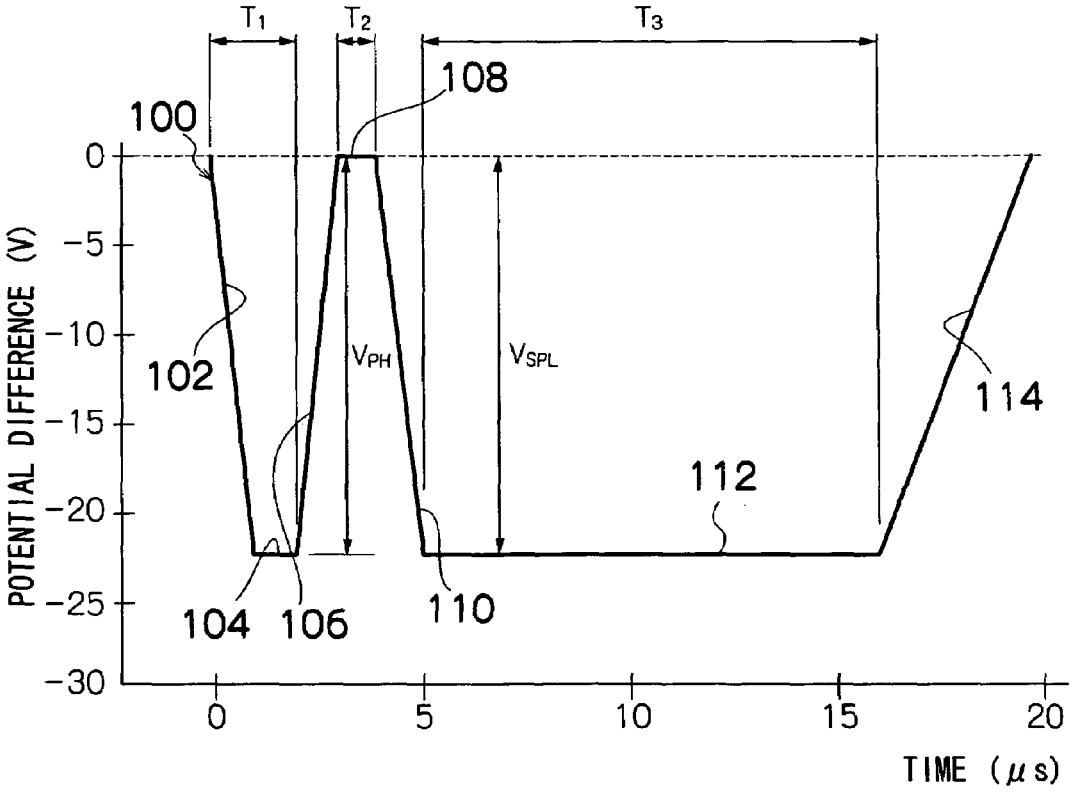
FIG. 7 is a waveform diagram showing a further embodiment of a drive signal.

FIG. 6 shows the waveform in which the amount of the second pull action (corresponding to the potential difference $V_{SPL}$) is greater than the amount of the push action (corresponding to the potential difference $V_{PH}$), but another mode is also possible in which the amount of the second pull $V_{SPL}$ is equal to the amount of push $V_{PH}$, as a waveform shown in FIG. 7. In FIG. 7, elements which are the same as or similar to those in FIG. 6 are denoted with the same reference numerals and description thereof is omitted here.

Characteristic feature (4): The period T3 for which the second pulled state is maintained is longer than the period T1 from the first pull action until the push action. Refilling is promoted during this period T3.

Characteristic feature (5): The gradient of the static state restoration waveform component 114 is a gentler gradient than that of the push drive waveform component 106 during ejection. This is in order to prevent the liquid from being ejected by the static state restoration waveform component 114.

Detailed Conditions of Ink Chamber Unit in Print Head

Next, the structure of the ink chamber unit 53 shown in FIG. 4 is described in detail.

The print head 50 is composed in such a manner that a prescribed ejection frequency can be achieved by performing a pull and push action (pull-push-pull drive) utilizing the resonance between the compressibility (compliance) of the pressure chamber 52 and the inertia (inertance) of the supply side flow channel including the nozzle 51 and the ink supply port 54 (hereafter, this may be referred to simply as the supply port 54).

Figure 8:
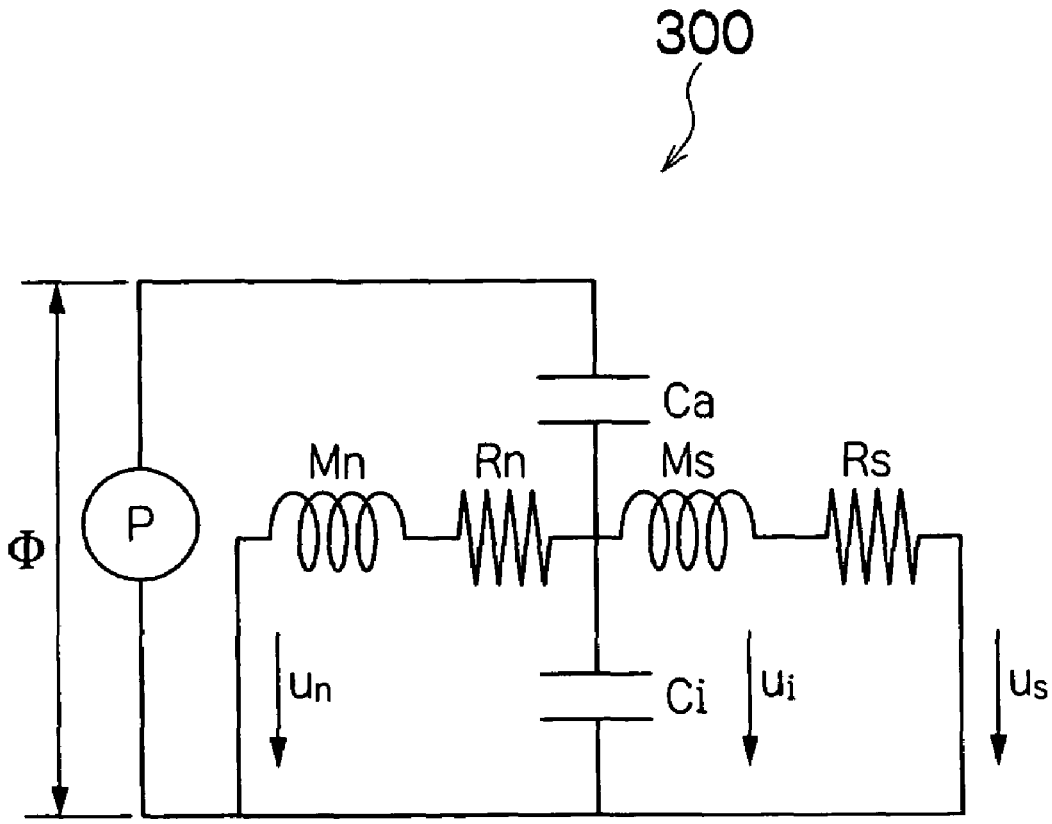
FIG. 8 is a diagram showing a lumped constant model of the print head shown in FIGS. 3A to 4.

FIG. 8 shows a lumped constant model (lumped constant circuit) 300 in which the functions (characteristics) of the ink chamber unit 53 shown in FIG. 4 have been replaced with an equivalent electrical circuit.

In the lumped constant model 300 shown in FIG. 8, Mn represents the inertance of the nozzle 51, Rn represents the resistance of the nozzle 51, Ms represents the inertance of the supply port 54, Rs represents the resistance of the supply port 54, Ci represents the compliance of the pressure chamber 52, and Ca represents the compliance of the actuator 58, and they are expressed by the following formulas (2) to (7):

$$Mn = \rho \times \frac{ln}{An}; \tag{2}$$

$$Rn = 8 \times \pi \times \nu \times \frac{ln}{An^2}; \tag{3}$$

$$Ms = \rho \times \frac{ls}{As}; \tag{4}$$

$$Rs = 8 \times \pi \times \nu \times \frac{ls}{As^2}; \tag{5}$$

$$Ci = \frac{V}{\rho \times c^2}; \text{ and} \tag{6}$$

$$Ca = \frac{X}{P}, \tag{7}$$

where ρ is the ink density, ν is the ink viscosity, ln is the length of the flow channel of the nozzle 51 (see FIG. 4), An is the surface area (cross-sectional area) of the nozzle 51, rn is the radius of the nozzle 51 (the diameter Dn of the nozzle 51 is indicated in FIG. 4), ls is the flow channel length of the supply port 54 (see FIG. 4), As is the surface area (cross-sectional area) of the supply port 54, V is the volume of the pressure chamber 52, c is the speed of sound in ink, P is the pressure generated by the actuator 58 when the removed volume is X, and X is the volume removed by the actuator 58 when the generated pressure is P.

The compliance Cn due to the surface tension at the nozzle 51 is sufficiently small compared to the compliance Ci of the pressure chamber 52 and hence this capacitance component is virtually negligible. Therefore, Cn is omitted from the system shown by the lumped constant model 300 in FIG. 8. Furthermore, the removed volume X is the sum total (V1+V2+V3) of the volume of ink V1 ejected to the exterior from the nozzle 51, the volume of ink V2 returning to the supply side, and the volume of ink V3 compressed due to application of pressure.

In FIG. 8, un is the volumetric speed of the ink flowing in the nozzle 51, ui is the volumetric speed of the ink flowing in the pressure chamber 52, us is the volumetric speed of the ink flowing in the supply port 54, and Φ is the pressure applied to the whole system when the actuator 58 is operated.

The differential equations of the lumped constant model 300 shown in FIG. 8 are expressed as:

$$\Phi = \frac{1}{Ca} \times \int (un + ui + us)dt + \frac{1}{Ci} \times \int uidt; \tag{8}$$

$$\frac{1}{Ci} \times \int uidt = Rn \times un + Mn \times \frac{dun}{dt}; \text{ and} \tag{9}$$

$$\frac{1}{Ci} \times \int uidt = Rs \times us + Ms \times \frac{dus}{dt}. \tag{10}$$

The pressure Pn applied at the nozzle 51 (the force obtained due to the action of the inertance Mn of the nozzle 51 and the fluid resistance Rn of the nozzle 51) is expressed by the following formula (11):

$$Pn = Rn \times un + Mn \times \frac{dun}{dt}. \tag{11}$$

Figure 9:
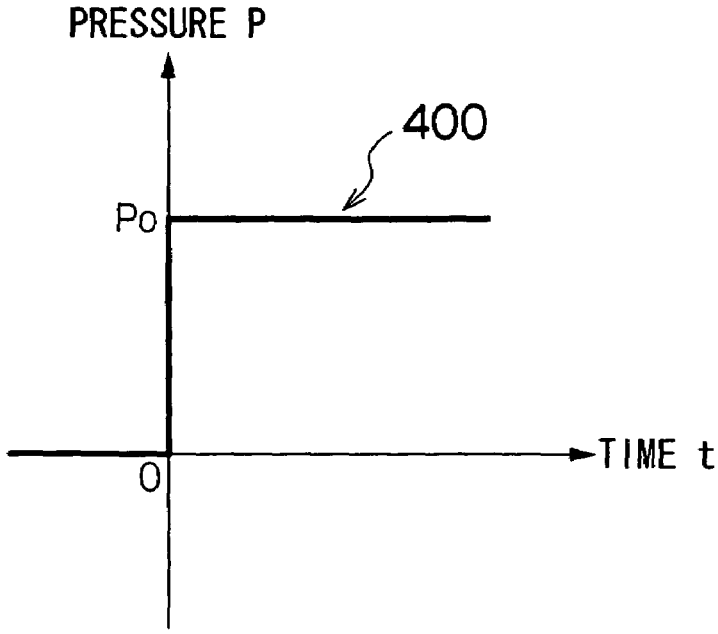
FIG. 9 is a diagram showing an example of the input pressure when determining the volumetric speed of the ink inside the nozzle.

When the aforementioned simultaneous differential equations are solved for an input waveform that is a square push wave (the step function 400 shown in FIG. 9), then the volumetric speed un of the ink in the nozzle 51 is represented by the following formula (12) and the pressure Pn at the nozzle section is represented by the following formula (13) (the method of solving these differential equations is commonly known and is therefore not described in the present specification):

$$un = \frac{Ca \times P_0}{Mn \times C \times E} \times \exp(-D \times t) \times \sin(E \times t); \text{ and} \tag{12}$$

$$Pn(t) = \frac{Ca \times P_0}{C \times E} \times (D \times \sin(E \times t) + E \times \cos(E \times t))\exp(-D \times t), \tag{13}$$

where C, D, and E are expressed as follows:

$$C = Ca + Ci; \tag{14}$$

$$D = \frac{R}{2 \times M}; \text{ and} \tag{15}$$

$$E = \frac{1}{2 \times C \times M} \times \sqrt{4 \times M \times C - R^2 \times C^2}, \tag{16}$$

where M and R are constants which satisfy the following formulas:

$$M = \frac{Mn \times Ms}{Mn + Ms}; \text{ and} \tag{17}$$

$$R = \frac{Rn \times Rs}{Rn + Rs}. \tag{18}$$

Furthermore, $P_0$ represents the magnitude (absolute value) of the pressure (Φ in FIG. 8) applied to the whole system, when the actuator is driven.

When the temporal change is found by differentiating Pn(t) indicated in the above-described formula (13), then it can be seen that it has an extreme value (maximum or minimum value) when t=n×(π/E) (where n is an integer).

Supposing that n=0 or 1, then these situations can be expressed by the following formulas:

$$Pn = \frac{Ca \times P_0}{C} \quad (\text{when } t = 0); \text{ and} \tag{19}$$

$$Pn = \frac{Ca \times P_0}{C} \times \exp\left(-\frac{D \times \pi}{E}\right) \quad (\text{when } t = \pi / E). \tag{20}$$

The sudden attenuation of the applied pressure wave means that the absolute value of the pressure at t=π/E is small. A concrete value for this can be specified when the absolute value of the second extreme value is not more than 1/e of the absolute value of the initial extreme value. This condition is expressed as:

$$|Pn(0)| \geqq e|Pn(\pi/E)| \tag{21}$$

By rewriting the formula (21) using the formulas (19) and (20), the following formula (22) is obtained:

$$1 \geq \exp\left(1 - \frac{D \times \pi}{E}\right). \tag{22}$$

This can be rewritten as:

$$1 \leq \frac{D \times \pi}{E}. \tag{23}$$

By rewriting the formula (23) using the formulas (15) and (16), the following formula (24) is obtained:

$$\sqrt{\frac{4}{1+\pi^2}} \sqrt{\frac{M}{C}} \leq R. \tag{24}$$

On the other hand, since each of D and E is positive if the pressure change makes damped oscillation, then the following formula (25) is obtained:

$$2\sqrt{\frac{M}{C}} \geq R. \tag{25}$$

Rearranging the above-described conditions gives the following formula (26):

$$\frac{1}{\sqrt{1+\pi^2}} \times \sqrt{\frac{\rho \times ln \times ls}{(ln \times As + ls \times An) \times \left(\frac{V}{\rho \times c^2} + \frac{X}{P}\right)}} \leq 4 \times \pi \times \nu \times \frac{ln \times ls}{ln \times As^2 + ls \times An^2} \leq \sqrt{\frac{\rho \times ln \times ls}{(ln \times As + ls \times An) \times \left(\frac{V}{\rho \times c^2} + \frac{X}{P}\right)}}. \tag{26}$$

From the foregoing, very small liquid droplets can be ejected by means of drive waveforms according to the embodiment of the present invention, by designing the head in such a manner that the conditions stated above are satisfied.

Figure 10:
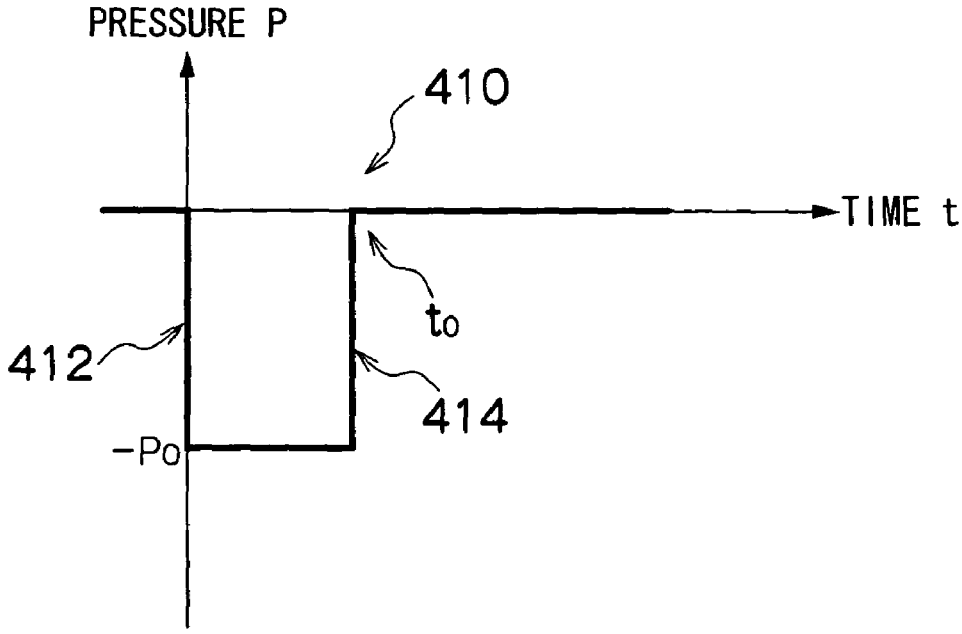
FIG. 10 is a diagram showing another example of the input pressure when determining the volumetric speed of the ink inside the nozzle.

Here, the conditions which produce the maximum ejection force are considered, for a case where the input waveform is a square-shaped pull-push waveform such as that shown in FIG. 10.

On the basis of the formula (12), which indicates the volumetric speed in the step input, the volumetric speed in the pull-push waveform 410 shown in FIG. 10 can be expressed by the following formula (27):

$$una(t) = \begin{cases} -un(t) & t < t_0 \\ -un(t) + un(t - t_0) & t \geq t_0. \end{cases} \tag{27}$$

Since the ejection range is $t \geqq t_0$, then the following formula (28) is established:

$$\begin{aligned} una(t) &= -un(t) + un(t - un(t - t_D) \\ &= \frac{Ca \times P_0}{Mn \times C \times E} \times [-\exp(-D \times t) \times \sin(E \times t) + \\ &\quad \exp\{-D \times (t - t_0)\} \times \sin\{E \times (t - t_0)\}]. \end{aligned} \tag{28}$$

With respect to the function (−un(t)) of the volumetric speed generated by the pull waveform component 412 in FIG. 10, if the function ($un(t-t_0)$) of the volumetric speed generated by the push waveform component 414 is sifted by one half of the intrinsic oscillation cycle Te=2π/E (namely, by π/E) in phase, then these functions cause constructive interference with each other and a maximum ejection force is obtained. Therefore, in the formula (29), it is preferable that $t_0$=π/E. In other words, the period Tpp in which the liquid is ejected most quickly by means of a simply pull and push ejection (a square-shaped pull-push drive waveform) is one half of the intrinsic oscillation cycle Te, i.e., $t_0$=π/E, as described above.

Embodiments of Head Design

FIG. 11 is a table showing an embodiment of the design of the print head. The pressure chamber has a square planar shape with sides of 300 μm, and has a height of 125 μm. The supply port has a long side of 60 μm and a short side of 30 μm in cross-section, and has a length (the flow channel length of the supply port) of 200 μm. The nozzle is a circular channel of 20 μm diameter and 20 μm length. The characteristics of the actuator are that the pressure of 2 MPa is generated and the removed volume is 20 picoliters (pl) when the drive voltage of 30 V at the peak value is applied, and the resonance point is 1 MHz. The ink used has the viscosity of 20 cP and the surface tension of 30 mN/m.

When carrying out ejection driving by means of the drive signal 100 shown in FIG. 6 or 7 in the head designed as described above, a liquid droplet of 1.8 pl is ejected at 7 m/s.

The conditions shown here are just one embodiment, and the present invention is not limited to these conditions in implementation. The range of the viscosity of the liquid that can be ejected in the above-described head design is 17 through 35 cP. For example, the numerical range of the head design for liquid of the viscosity of 20 cP allows a variation in the height of the pressure chamber within a range of 100 through 125 μm, while keeping the design values other than the height of the pressure chamber unchanged. On the other hand, the longer side of the cross-sectional shape of the supply port can be varied within a range of 60 through 80 μm, while keeping the design values other than the longer side of the cross-sectional shape of the supply port unchanged.

If the height of the pressure chamber or the length of the longer side of the cross-sectional shape of the supply port is changed from the numeric values in the diagram, then although it is permissible to vary either one of these dimensions, if both dimensions are changed at the same time, then this makes ejection difficult.

Furthermore, the head design for liquid of the viscosity of 15 cP includes, for example, the pressure chamber having a square planar shape with sides of 300 μm and a height of 100 μm, and the supply port having a long side of 40 μm and a short side of 30 μm in cross-section, and a length of 200 μm (the other parameters are the same as in the embodiment in FIG. 11). In this design, the height of the pressure chamber can be varied within a range of 100 through 125 μm, and the length of the long side of the cross-sectional shape of the supply port can be varied within a range of 30 through 40 μm.

In the foregoing description, the inkjet recording apparatus is described as one embodiment of the liquid ejection apparatus, but the scope of application of the present invention is not limited to this, and the present invention may also be applied to a liquid ejection apparatus used for a variety of applications (such as an image forming apparatus, application apparatus, coating apparatus, spraying apparatus, wire forming apparatus, and the like) which deposits liquid onto an ejection receiving medium by ejecting the liquid onto the ejection receiving medium.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A liquid ejection apparatus, comprising:

a nozzle which ejects liquid;

a pressure chamber which is connected to the nozzle and filled with the liquid to be ejected from the nozzle;

an actuator which causes the liquid to be ejected from the nozzle by applying a pressure change to the liquid inside the pressure chamber, by changing volume of the pressure chamber; and a drive signal generating device which generates a drive signal for driving the actuator, wherein the drive signal includes:

a first pull drive waveform component which drives the actuator to increase the volume of the pressure chamber;

a push drive waveform component which drives the actuator to reduce the volume of the pressure chamber by a first volume change amount after the first pull drive waveform component, so as to push out a column of the liquid from the nozzle; and a second pull drive waveform component which drives the actuator to again increase the volume of the pressure chamber by a second volume change amount after the push drive waveform component, so as to sever the column of the liquid, an absolute value of the second volume change amount being not less than an absolute value of the first volume change amount; and wherein an intrinsic oscillation cycle Te of a volumetric speed of the liquid in the nozzle, and a period T1 from a first pull action due to the first pull drive waveform component until a push action due to the push drive waveform component, satisfy the following relationship:

$$(Te/2)-1\ \mu s \leqq T1 \leqq (Te/2)+1\ \mu s.$$

2. The liquid ejection apparatus as defined in claim 1, wherein a period T2 from a push action due to the push drive waveform component until a pull action due to the second pull drive waveform component, is not longer than a period T1 from a first pull action due to the first pull drive waveform component until the push action due to the push drive waveform component.

3. An image forming apparatus, comprising the liquid ejection apparatus as defined in claim 1 which forms an image on a recording medium by means of an ink liquid ejected from the nozzle.

4. A liquid ejection apparatus, comprising:

a nozzle which ejects liquid:

a pressure chamber which is connected to the nozzle and filled with the liquid to be ejected from the nozzle;

an actuator which causes the liquid to be ejected from the nozzle by applying a pressure change to the liquid inside the pressure chamber, by changing volume of the pressure chamber; and a drive signal generating device which generates a drive signal for driving the actuator, wherein the drive signal includes:

a first pull drive waveform component which drives the actuator to increase the volume of the pressure chamber;

a push drive waveform component which drives the actuator to reduce the volume of the pressure chamber by a first volume change amount after the first pull drive waveform component, so as to push out a column of the liquid from the nozzle;

a second pull drive waveform component which drives the actuator to again increase the volume of the pressure chamber by a second volume change amount after the push drive waveform component, so as to sever the column of the liquid, an absolute value of the second volume change amount being not less than an absolute value of the first volume change amount;

a pull holding waveform component which drives the actuator to hold an expanded state of the pressure chamber of which the volume has been increased by the second pull drive waveform component; and a static state restoration waveform component which drives the actuator to reduce the volume of the pressure chamber having been held in the expanded state by the pull holding waveform component, so as to return the pressure chamber to a static state.

5. The liquid ejection apparatus as defined in claim 4, wherein a period T3 during which the pressure chamber is held in the expanded state by the pull holding waveform component is longer than a period T1 from a first pull action due to the first pull drive waveform component until a push action due to the push drive waveform component.

6. The liquid ejection apparatus as defined in claim 4, wherein the static state restoration waveform component has a gradient less than a gradient of the push drive waveform component.

7. The liquid ejection apparatus as defined in claim 4, wherein a period T2 from a push action due to the push drive waveform component until a pull action due to the second pull drive waveform component, is not longer than a period T1 from a first pull action due to the first pull drive waveform component until the push action due to the push drive waveform component.

8. An image forming apparatus, comprising the liquid ejection apparatus as defined in claim 4, which forms an image on a recording medium by means of an ink liquid ejected from the nozzle.

9. A liquid ejection apparatus, comprising:

a nozzle which ejects liquid;

a pressure chamber which is connected to the nozzle and filled with the liquid to be ejected from the nozzle;

an actuator which causes the liquid to be ejected from the nozzle by applying a pressure change to the liquid inside the pressure chamber, by changing volume of the pressure chamber; and a drive signal generating device which generates a drive signal for driving the actuator, wherein the drive signal includes:

a first pull drive waveform component which drives the actuator to increase the volume of the pressure chamber;

a push drive waveform component which drives the actuator to reduce the volume of the pressure chamber by a first volume change amount after the first pull drive waveform component, so as to push out a column of the liquid from the nozzle; and a second pull drive waveform component which drives the actuator to again increase the volume of the pressure chamber by a second volume change amount after the push drive waveform component, so as to sever the column of the liquid, an absolute value of the second volume change amount being not less than an absolute value of the first volume change amount; and wherein the liquid has viscosity of 10 cP through 50 cP.

10. The liquid ejection apparatus as defined in claim 9, wherein a period T2 from a push action due to the push drive waveform component until a pull action due to the second pull drive waveform component, is not longer than a period T1 from a first pull action due to the first pull drive waveform component until the push action due to the push drive waveform component.

11. An image forming apparatus, comprising the liquid ejection apparatus as defined in claim 9, which forms an image on a recording medium by means of an ink liquid ejected from the nozzle.

12. A liquid ejection apparatus, comprising:

a nozzle which ejects liquid;

a pressure chamber which is connected to the nozzle and filled with the liquid to be ejected from the nozzle;

an actuator which causes the liquid to be ejected from the nozzle by applying a pressure change to the liquid inside the pressure chamber, by changing volume of the pressure chamber; and a drive signal generating device which generates a drive signal for driving the actuator, wherein the drive signal includes:

a first pull drive waveform component which drives the actuator to increase the volume of the pressure chamber;

a push drive waveform component which drives the actuator to reduce the volume of the pressure chamber by a first volume change amount after the first pull drive waveform component, so as to push out a column of the liquid from the nozzle; and a second pull drive waveform component which drives the actuator to again increase the volume of the pressure chamber by a second volume change amount after the push drive waveform component, so as to sever the column of the liquid, an absolute value of the second volume change amount being not less than an absolute value of the first volume change amount; and wherein the following relationship is satisfied:

$$\frac{1}{\sqrt{1+\pi^2}} \times \sqrt{\frac{\rho \times \ln \times ls}{(\ln \times As + ls \times An) \times \left(\frac{V}{\rho \times c^2} + \frac{X}{P}\right)}} \leq$$

$$4 \times \pi \times v \times \frac{\ln \times ls}{\ln \times As^2 + ls \times An^2} \leq \sqrt{\frac{\rho \times \ln \times ls}{(\ln \times As + ls \times An) \times \left(\frac{V}{\rho \times c^2} + \frac{X}{P}\right)}},$$

where ln is a length of the nozzle; An is a surface area of the nozzle; ls is a flow channel length of a supply port through which the liquid is supplied to the pressure chamber; As is a surface are of the supply port; ρ is a density of the liquid; v is a viscosity of the liquid; c is a speed of sound in the liquid; V is the volume of the pressure chamber; P is pressure generated by the actuator when a removed volume is X; and X is the removed volume by the actuator when the generated pressure is P.

13. The liquid ejection apparatus as defined in claim 12, wherein a period T2 from a push action due to the push drive waveform component until a pull action due to the second pull drive waveform component, is not longer than a period T1 from a first pull action due to the first pull drive waveform component until the push action due to the push drive waveform component.

14. An image forming apparatus, comprising the liquid ejection apparatus as defined in claim 12, which forms an image on a recording medium by means of an ink liquid ejected from the nozzle.

15. A liquid ejection apparatus, comprising:

a nozzle which ejects liquid;

a pressure chamber which is connected to the nozzle and filled with the liquid to be ejected from the nozzle;

an actuator which causes the liquid to be ejected from the nozzle by applying a pressure change to the liquid inside the pressure chamber, by changing volume of the pressure chamber; and a drive signal generating device which generates a drive signal for driving the actuator, wherein the drive signal includes:

a first pull drive waveform component which drives the actuator to increase the volume of the pressure chamber;

a push drive waveform component which drives the actuator to reduce the volume of the pressure chamber by a first volume change amount after the first pull drive waveform component, so as to push out a column of the liquid from the nozzle; and a second pull drive waveform component which drives the actuator to again increase the volume of the pressure chamber by a second volume change amount after the push drive waveform component, so as to sever the column of the liquid, an absolute value of the second volume change amount being greater than an absolute value of the first volume change amount.

16. The liquid ejection apparatus as defined in claim 15, wherein a period T2 from a push action due to the push drive waveform component until a pull action due to the second pull drive waveform component, is not longer than a period T1 from a first pull action due to the first pull drive waveform component until the push action due to the push drive waveform component.

17. An image forming apparatus, comprising the liquid ejection apparatus as defined in claim 15, which forms an image on a recording medium by means of an ink liquid ejected from the nozzle.

* * * * *